137-13 SR
4/24/79 XR 4,150,700

United States Patent [19]
Fox, Jr.

[11] 4,150,700
[45] Apr. 24, 1979

[54] METHOD AND SYSTEM FOR HANDLING BULK SHIPMENTS OF A FLOWABLE PRODUCT

[75] Inventor: Kenneth L. Fox, Jr., Winnetka, Ill.

[73] Assignee: Mid-America Sweeteners, Inc., Skokie, Ill.

[21] Appl. No.: 871,451

[22] Filed: Jan. 23, 1978

[51] Int. Cl.[2] ..... B65B 3/14
[52] U.S. Cl. ..... 141/11; 134/166 C; 137/13; 137/209; 141/91; 141/232
[58] Field of Search ..... 105/358, 360; 137/13, 137/209; 141/11, 35, 67, 82, 98, 91, 113, 231, 232, 233, 284, 324, 387, 388; 134/166 C, 167 C, 168 C

[56] References Cited

U.S. PATENT DOCUMENTS

| | | | |
|---|---|---|---|
| 2,224,403 | 12/1940 | Lines | 137/13 X |
| 2,630,249 | 3/1953 | Bryant et al. | 137/209 X |
| 2,918,928 | 12/1959 | Rednour | 137/209 X |
| 2,940,518 | 6/1960 | Lawler et al. | 137/13 |
| 3,884,373 | 5/1975 | Archibald | 105/358 X |
| 3,974,864 | 8/1976 | Fournier et al. | 141/387 X |

*Primary Examiner*—Richard E. Aegerter
*Assistant Examiner*—Frederick R. Schmidt
*Attorney, Agent, or Firm*—Neuman, Williams, Anderson & Olson

[57] ABSTRACT

A method and system are provided for handling a flowable product when transferring same from one bulk container, such as a railroad tank car, to a second bulk container of smaller capacity, such as a tank truck. A fitting is removably mounted on a valved product discharge port provided on the one container. The fitting includes an inlet for a compressed fluid. A removable duct section connects the fitting to a valved product inlet port provided on the second container. The interior of the first container is charged to a predetermined pressure by the compressed fluid while the valved discharge port is closed. The product is transferred from the charged one container to the other container through the duct section when the valved ports of both containers are opened. Once the desired amount of product has been transferred, the valved discharge port is closed, the source of compressed fluid is connected to the fitting inlet whereupon the duct section is purged of the product and then the valved inlet port is closed, the source of compressed fluid disconnected from the fitting and the duct section disconnected from the inlet port of the second container.

13 Claims, 8 Drawing Figures

METHOD AND SYSTEM FOR HANDLING BULK SHIPMENTS OF A FLOWABLE PRODUCT

BACKGROUND OF THE INVENTION

Heretofore, the bulk handling of various products, such as corn syrup, fructose and the like, has always been fraught with problems due to certain inherent characteristics of the product itself, such as viscidity, viscosity, etc., and the environment, such as low temperature, etc., within which the product is being handled. In the past when handling such a product, it has been customary to utilize high capacity, heavy duty pumps which must be capable of being readily cleaned, normally by being wholly or partially disassembled. Because of the heavy load to which the pump is subjected, an inordinate amount of time and effort is expended for servicing and repairing same, and the energy input required to operate the pump is excessively high. Furthermore, such pumps must be capable of operating under widely varying climatic conditions and at the same time be capable of withstanding abusive treatment.

In addition to the problems associated with the equipment utilized in handling the product, an excessive amount of manual labor was involved requiring the efforts of numerous personnel. The attractiveness of the product, when corn syrup or fructose, to bees and other insects oftentimes interferes with the manual operation of connecting and disconnecting the duct with respect to the railroad tank car and/or the tank truck because in the past a large amount of product spillage resulted.

Where preheating the product was necessary to facilitate handling thereof, certain portions of the product became scorched, or otherwise deleteriously affected, thus materially impairing the utility and marketability of the product.

Even in prior instances where the pump was operating properly and the product was in a readily flowable state, an inordinate amount of time was required to transfer the product from a tank car to a tank truck.

Furthermore, in prior systems for handling such products special and costly tools and equipment were oftentimes required and the system was incapable of accommodating tank cars and trucks which varied widely in size and shape.

SUMMARY OF THE INVENTION

Thus, it is an object of the invention to provide a method of handling bulk shipments of flowable products which is extremely simple, yet effective and efficient in operation; requires a minimal amount of labor; and is capable of readily handling a variety of products.

It is a further object of the invention to provide apparatus which operates consistently and uniformly under extreme variations in climatic conditions.

It is a still further object of the invention to provide a method and apparatus which significantly expedites the transfer of the product from one bulk container to a second bulk container with a minimal amount of personnel required.

It is a still further object of the invention to provide a method and apparatus where the product is not exposed to contamination during transfer and product spillage is avoided or negligible.

It is a still further object of the invention to provide a method and apparatus which requires a minimal amount of energy input to effect the transfer of the product.

It is a still further object of the invention to provide a method and apparatus which may be utilized with bulk containers which vary in size and shape over a wide range.

It is a still further object of the invention to provide a method and apparatus wherein blending of various products may occur under controlled conditions either while one of the products is disposed within one bulk container or while the one product is being discharged from the one container and before it enters a second container.

It is a still further object to provide a method and apparatus whereby a plurality of railroad tank cars can be simultaneously unloaded into a plurality of tank trucks at a given terminal.

It is a still further object to provide a method and apparatus which enables multiple unloading operations to occur while other railroad tank cars are being precharged with a pressurized fluid and/or preheated preparatory to subsequent unloading.

Further and additional objects will appear from the description, accompanying drawings and appended claims.

In accordance with one embodiment of the invention a method is provided for transferring a flowable product from a first bulk container to a second bulk container. The first container is provided with a discharge port connected to the lower portion thereof and having an on-off valve associated therewith. In addition, the first container is provided with means for introducing into the interior thereof pressurized fluid which is inert to the flowable product and will accumulate within the first container and will maintain a predetermined pressure therein even while the product is being removed therefrom. The second container is provided with an inlet port and an on-off valve associated therewith. The second container is provided with means for relieving pressure buildup within the interior thereof. The discharge port of the first container is connected to the inlet port of the second container by a duct which, when desired, may be readily connected and disconnected relative to the respective ports. Where optimum flowability of the product will be attained, when the product is at a predetermined temperature, a means is provided for accomplishing this result by applying heat interiorly and/or exteriorly of the first container without scorching or otherwise deleteriously affecting the product.

Once the desired amount of flowable product has been transferred from the first container to the second container, the valve at the discharge port is closed and the pressurized fluid is introduced into the duct near the connection between the duct and the discharge port, thereby causing any residue of the product within the duct to flow through the inlet port of the second container. Once this has occurred, the valve at the inlet port is closed and the duct disconnected from the containers without any, or only a neglible amount of, product spillage.

DESCRIPTION

For a more complete understanding of the invention reference should be made to the drawings wherein:

FIG. 1 is a fragmentary plan view of a plurality of conventional railroad tank cars on parallel trackage and disposed at an unloading terminal; certain of the tank cars are shown as being simultaneously unloaded into adjacent tank trucks or trailers and at least one of the remaining tank cars is shown being preheated and precharged with a pressurized fluid preparatory to being unloaded.

FIG. 1*a* is an enlarged fragmentary plan view of a portion of FIG. 1.

Figure 1:
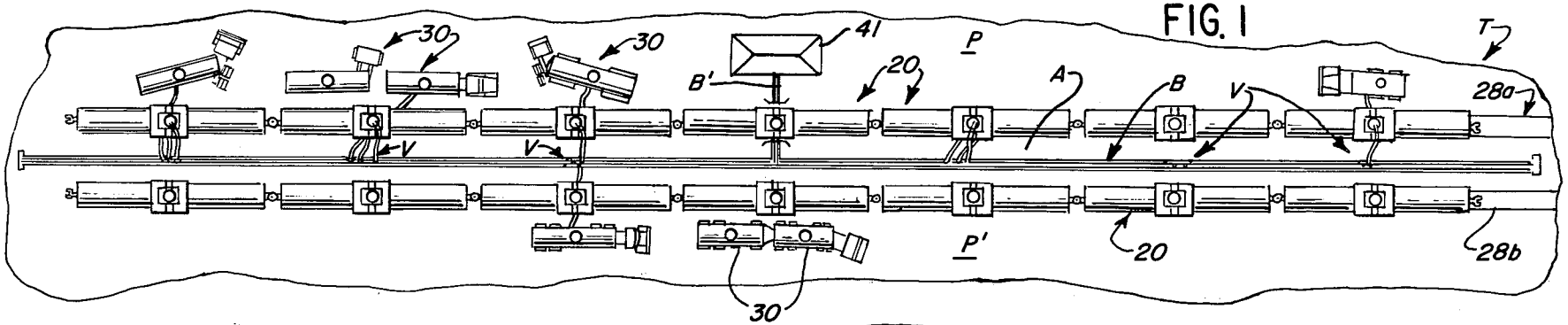
Figure 1A:
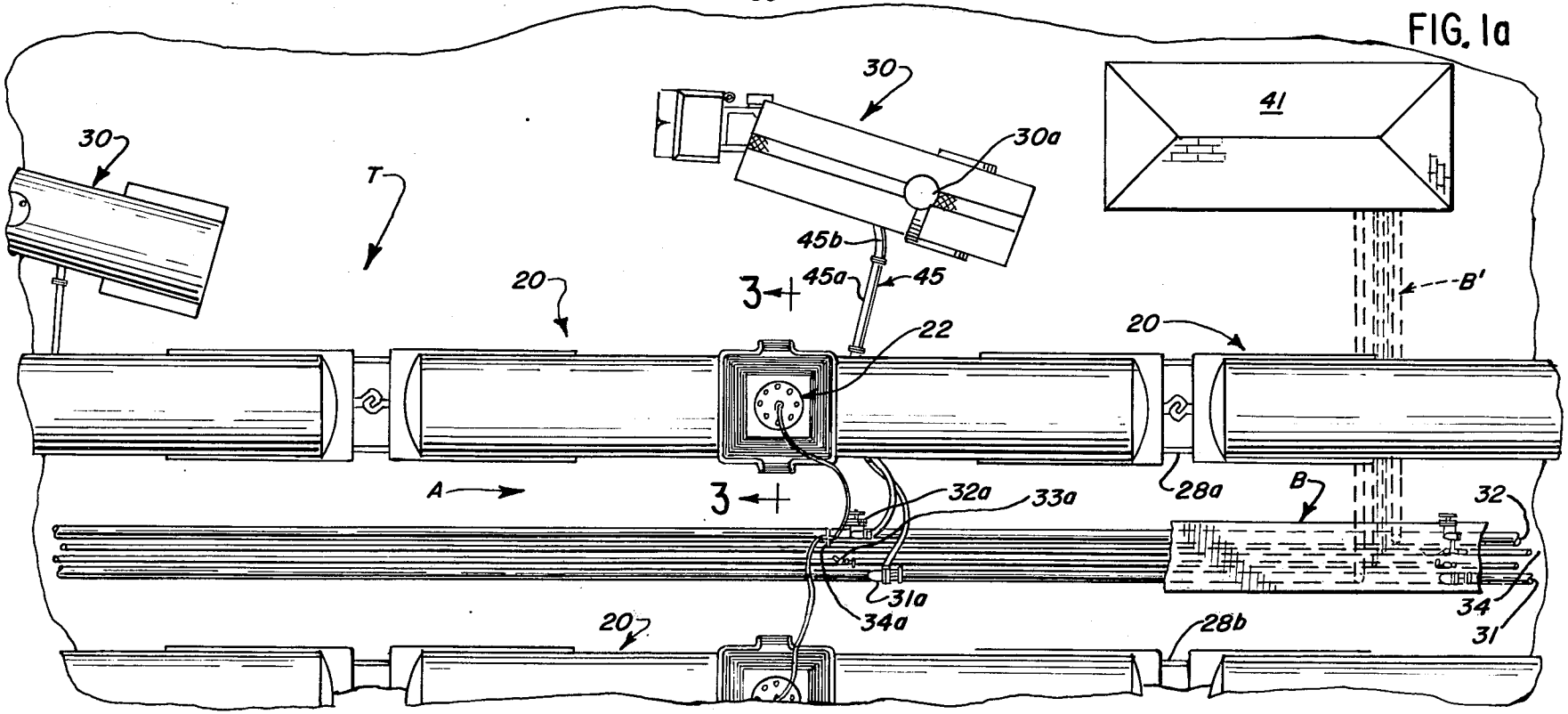

Referring now to the drawings and more particularly to FIGS. 1 and 1*a*, one form of a loading-unloading terminal T for railroad tank cars 20 is shown. The cars are of conventional tank car construction and each includes a cylindrical inner tank 21 (e.g., capacity 90,000–196,000 lbs.) in which the product is accumulated, an inspection dome 22 located at the top and substantially centrally of the tank 21 for access to the interior thereof, a product discharge port 23 disposed on the underside of the tank; and a manually adjustable on-off valve 24 associated with port 23, see FIG. 3.

The inner tank 21 is surrounded by a cylindrical outer protective wall 25. Disposed between the tank 21 and wall 25 and contacting the exterior of tank 21 is a tortuous heating pipe 26 through which steam, or some heating fluid, may be circulated so as to cause the inner tank 21 and its contents to be heated to a predetermined temperature. Suitable insulation 27 is placed between the pipe 26 and the outer wall 25 so as to reduce heat losses.

As seen in FIG. 1, the tank cars 20 are located on a pair of elongated sections of track 28*a*, 28*b*. The length of the track sections will depend upon the number of tank cars to be parked at one time at the terminal. By suitable switches, not shown, the track sections 28*a*, 28*b* form one or more spurs from other trackage, not shown.

Within the narrow elongated area A, separating the track sections 28*a*, 28*b* from one another, is located an elongated assembly B which may be either disposed entirely above or below ground level or just partially below ground level. The function and structural details of assembly B will be discussed hereinafter.

A truck, or vehicle, parking pavilion P, $P_1$ is provided ajacent to, but outwardly from, each track section 28*a*, 28*b*. Each pavilion is substantially coextensive with the adjacent track section and is provided with suitable ingress and egress means, not shown, for the trucks and/or vehicles 30. The tank truck, or vehicle, (tank trailer) is of conventional design and normally has a capacity of approximately 45,000 lbs. As seen in FIG. 1, the tank trucks are spotted along the pavilions P, $P_1$ so that each truck, or trailer, is positioned adjacent a selected tank car from which it is to receive the product.

Figure 7:
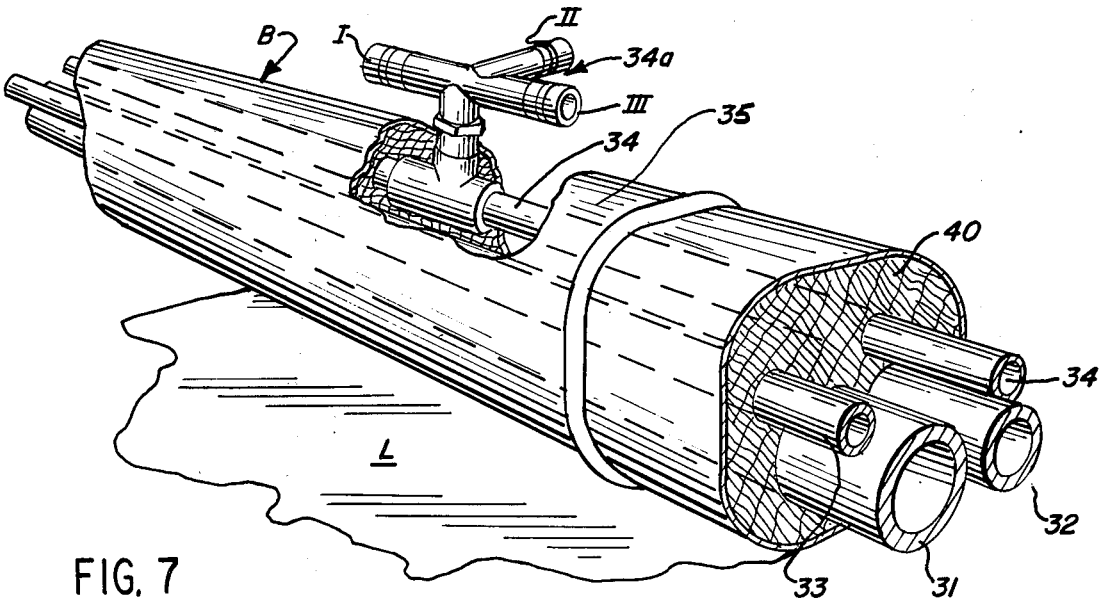
FIG. 7 is a fragmentary, perspective view, partially in vertical section, of one form of an assembly in which are disposed a plurality of feedlines for water, pressurized fluid and steam, and a condensate return line; a multi-outlet fitting connected to the feedline for pressurized fluid is also shown.

Assembly B, as seen more clearly in FIG. 7, includes a plurality of pipe sections 31, 32, 33, and 34 which are preferably banded together in a clustered relation. The pipe sections are encompassed with a suitable insulation 40 which, in turn, is covered over with a suitable protective material 35 which may be disposed above, below, or partially below the ground level L.

Pipe section 31 is a steam line; pipe section 32 is a steam condensate return line; pipe section 33 is a hot water line; and pipe section 34 is a compressed dry air line. A steam generator, a hot water heater, and a dry air compressor with an air filter associated therewith are preferably located within a shed or shelter 41 which is disposed within parking pavilion P. Extending from the shed towards the assembly B is a connector assembly B′ which is normally below ground level L and the corresponding pipe sections of the assemblies B, B′ are connected to one another by conventional T-connectors, not shown. It will be noted in FIG. 1 that assembly B extends in opposite directions from assembly B′ for substantially the full length of the track sections 28*a*, 28*b*.

Provided at predetermined longitudinally spaced stations V along assembly B are tap-in connector fittings 31*a*, 32*a*, 33*a*, and 34*a*, one for each pipe section comprising the assembly B. Fittings 31*a*, 32*a*, and 33*a* may include manually adjustable shut-off valves. Fitting 34*a*, as seen more clearly in FIG. 7, is provided with multi-outlets I, II and II, each of which embodies the female component of a quick connect-disconnect coupling. Thus, each of the outlets is open only when the male component of the coupling is joined with the female component. The male component is carried on one end of a section of flexible hose. Thus, by reason of the multiple outlets, two adjoining railroad tank cars can have the domes 22 thereof simultaneously charged with compressed air and the third outlet can be connected by a suitable hose section to the discharge port 23 of a third railroad tank car in a manner to be described more fully hereinafter.

The spacing between adjacent valve stations V is normally the length of a railroad tank car; however, the spacing is not critical because the flexible hose sections are of substantial lengths and thus may compensate for certain of the tank cars not being properly spotted along the track section 28*a*, 28*b*.

Figure 3:
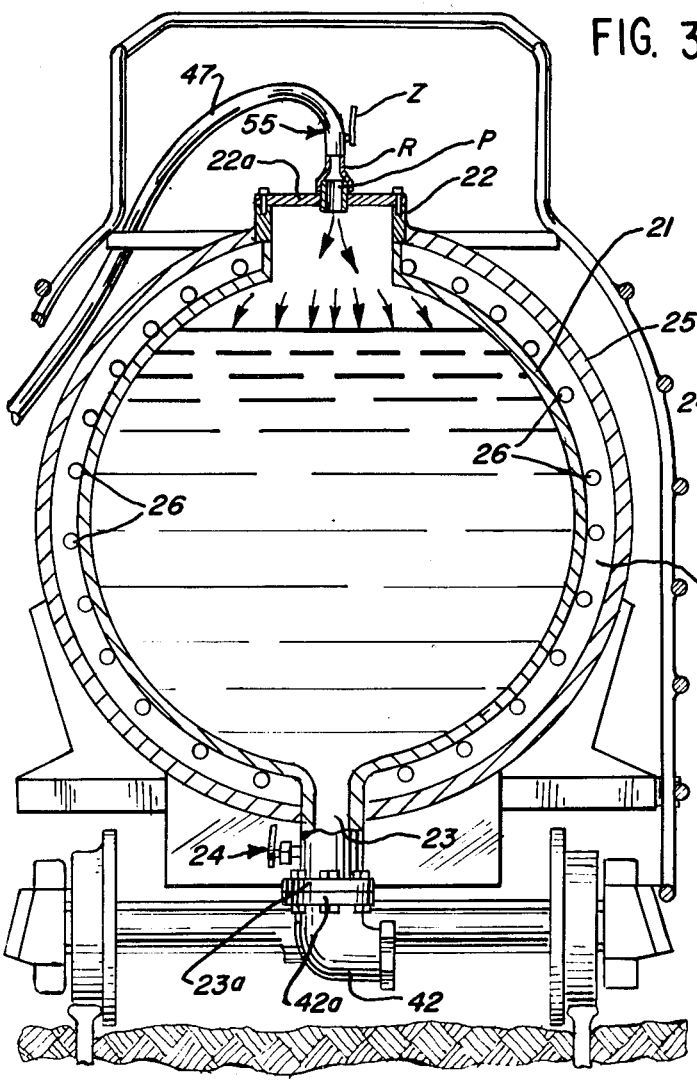
FIG. 3 is an enlarged, fragmentary, sectional view of a railroad tank car taken along line 3—3 of FIG. 1*a*.
Figure 4:
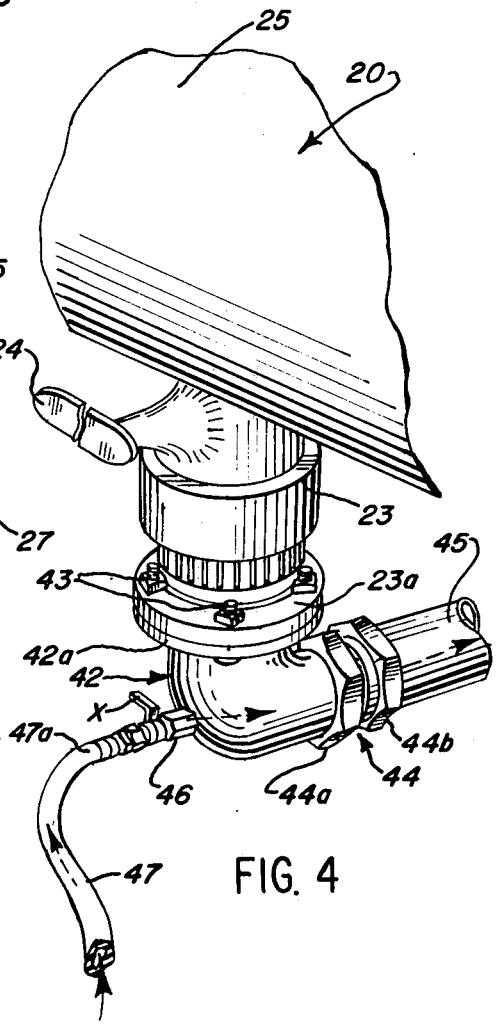
FIG. 4 is an enlarged, fragmentary, perspective view showing the discharge port of a railroad tank car, and one end of a duct and a fitting joining the duct end to the discharge port; said fitting having a pressurized fluid hose connected thereto.
Figure 5:
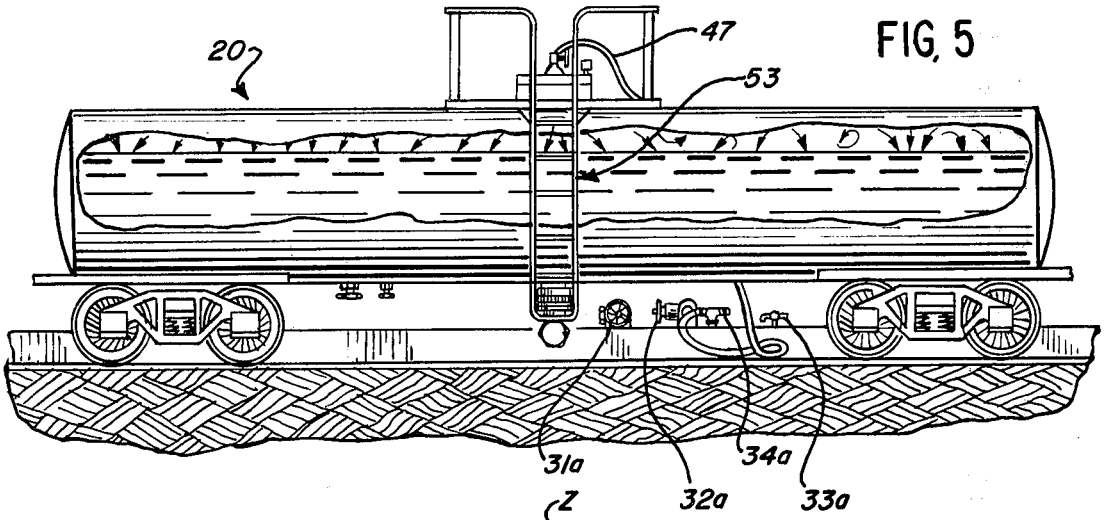
FIG. 5 is a fragmentary, side elevational view of one of the conventional railroad tank cars of FIG. 1 and with a portion of the tank wall being removed so as to show the interior of the tank while being charged with a pressurized fluid.

As noted in FIGS. 3 and 4, an elbow fitting 42 is mounted on the underside of the tank car 20 beneath the valve 24 by a plurality of nut and bolt units 43 which extend through mating flanges 23*a*, 42*a* formed on the car discharge port 23 and fitting 42, respectively. Normally, the fitting 42 is removed from the underside of the car 20 when the latter has been emptied. Other means for securing the fitting to port flange 23*a* may be utilized from that shown.

The opposite end of fitting 42 is provided with one component 44*a* of a quick connect-disconnect coupling 44. A second complemental component 44*b* of the coupling is attached to one end of an elongated duct section 45.

Intermediate the ends of the fitting 42 is a male component of a second, but smaller, quick connect-disconnect coupling 46 which is adapted to be engaged by a female component connected to one end 47*a* of the flexible hose section 47, the opposite end of which is provided with a male component of a quick connect-disconnect coupling and is connected to the female component mounted on one of the outlets of fitting 34*a*, the latter being connected to the compressed air feed-line 34 and disposed at an adjacent valve station V. The hose section end 47*a* is connected to coupling 46 when valve 24 has been adjusted to a closed position and it is desired to purge the product from the duct section 45, the latter connecting the discharge port 23 of the railroad tank car 20 to an inlet port 48 located on the underside of the tank truck 30, see FIG. 2. Mounted on elbow fitting 42 and associated with coupling 46 is a manually adjustable valve X, which varies the air pressure introduced into fitting 42 during the purging operation.

Duct section 45 may include a rigid light weight portion 45*a* connected to port 23 and a flexible portion 45*b*. The end of rigid portion 45*a* which is connected at 50 to an end of the flexible portion 45*b* may be supported by a suitable brace 51, if desired. In addition, portion 45*a* may be further supported by a strap 52 which is removably attached to and depends from a rung 53*a* of an upright ladder 53 commonly mounted on the exterior of the tank car 20.

Associated with the inlet port 45 of the tank truck 30 is a manually adjustable on-off valve 54. The ends of the flexible duct section 45*b* are provided with suitable fittings for readily connecting duct sections 45*a* and *b* and the tank truck inlet port 48. By having duct section 45*b* flexible, connecting and disconnecting thereof is facilitated and in addition such flexibility permits greater latitude in spotting the tank truck 30 relative to a particular railroad tank car 20.

Figure 2:
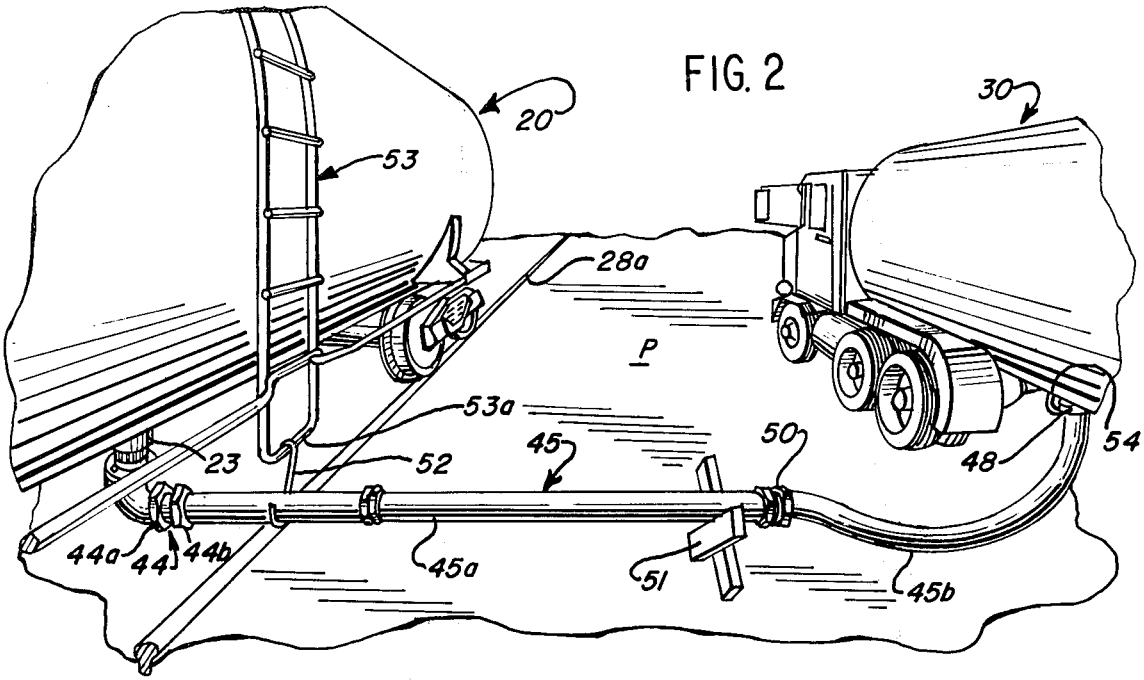
FIG. 2 is a fragmentary, perspective, substantially horizontal view showing one parked tank truck being loaded from an adjacent railroad tank car.

When the interior of the inner tank 21 of the tank car 20 is to be pre-charged with compressed air, as seen in FIG. 3, or the tank 21 is to be emptied, see FIG. 2, the end 47*a* of hose section 47, having the coupling female component carried thereon, is connected to a complemental male component of a quick connect-disconnect coupling 55 which in turn is connected to a reducer device R attached to a port P provided on a cover 22*a* comprising a part of the dome 22 formed at the top of tank car 20, see FIG. 3. Associated with the reducer device R is a manually adjustable valve Z which is closed when hose section 47 is disassembled from coupling 55 and thus prevents leakage of the compressed air out through port P.

During the pre-charge mode valve 24 is closed; whereas, when the tank is being emptied, valve 24 is in an open position. In both instances valve Z remains open provided the hose section 47 is connected to coupling 55. The inner tank 21 is normally provided with pressure relief valves, not shown, set to automatically open when the interior pressure of tank 21 exceeds a predetermined amount (e.g., approximately 65 psig). Thus, when charging tank 21 with the filtered compressed dry air, it is important that the interior pressure not exceed the said predetermined amount. The maximum compressed air pressure introduced into tank 21 can be adjusted by the combination of a pressure reducing device mounted on the top of the dome or by a pressure reducing device mounted after the air filtering devices immediately downstream from the air compressor.

During the product-transfer mode a dome cover 30*a*, normally formed on the top of the tank truck 30, is opened partially so as to prevent any pressure buildup within the truck tank while the latter is being filled with the product from the adjacent railroad tank car.

Figure 6:
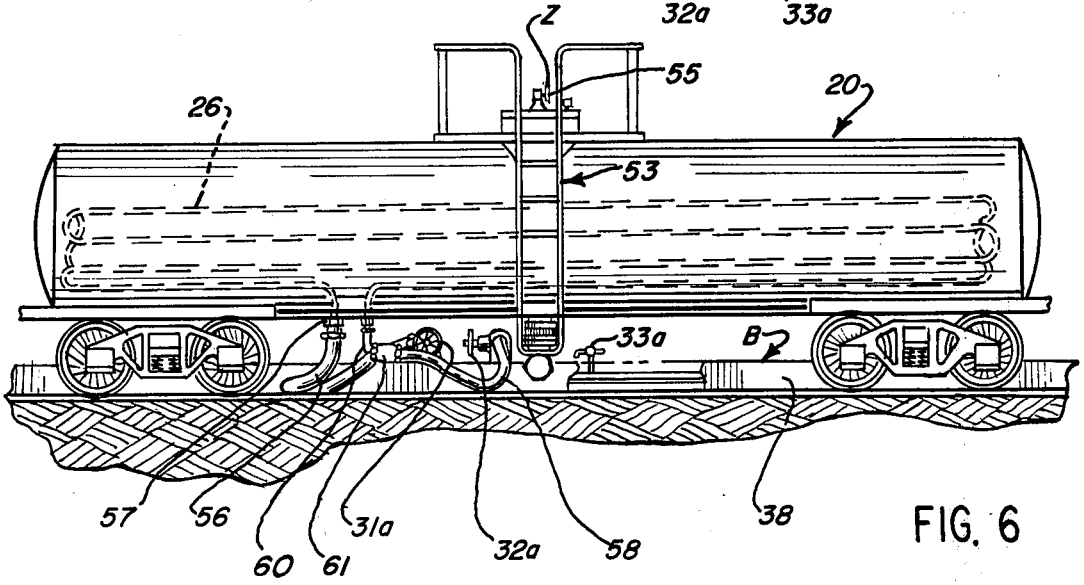
FIG. 6 is similar to FIG. 5 but showing one means for preheating the product within the tank car.

As aforementioned, a product, such as corn syrup, in order to readily flow from car 20 through duct section 45 and into the tank truck 30 should have a temperature of approximately 120° F. Where, however, the product involved is fructose, the latter must have a temperature of approximately 90° F. to prevent crystallization thereof. In certain climates and during certain times of the year, heating of the product within the tank 21 may not be required; however, in many instances heating, even though nominal, is required. Where there is to be only nominal heating, the heat of the compressed air itself might be sufficient to attain the desired temperature. In other instances, however, where greater heating of the product is required, a flexible hose section 56 is connected between the valved fitting 31*a* mounted on the steam line 31 at an adjacent station V and an inlet connection 57 mounted on the underside of the tank car 30, see FIG. 6. A flexible second hose section 58 is also used which interconnects the valved fitting 32*a*, mounted on the return line 32, and a steam outlet connection 60 mounted on the underside of car 30. A steam trap 61 is normally provided adjacent the outlet connection 60 so as to prevent steam condensate from entering the hose section 58.

As aforementioned the pipe sections 31–34 are banded together in a clustered relation, see FIG. 7, and are in contact with one another so that steam line 31 having a steam temperature of 235°–250° F. will heat the other lines 32–34 whereby the compressed air in line 34 will be preheated before it flows through the hose section 47. Thus, by reason of this arrangement no separate heating of the compressed air line 34, the water line 33, or the return line 32 is required.

The water line 33 provides a ready source of hot water at each valve station V and thus enables the interior of tank 21, when necessary, to be flushed out and cleaned after it has been emptied, or enables the interior of the truck tank 30 to be flushed out and cleaned before the product enters same. The valved fitting 33*a* provided at each station V enables a flexible hose section, not shown, to be connected thereto when cleaning with the hot water is required.

The procedure followed in transferring the product from a tank car 20 to a tank truck 30 is as follows: (a) the tank car 30 is first inspected to ascertain that none of its pressure relief valves have ruptured or accidentally opened and that the dome cover 22*a* is tightly closed; (b) the compressed air hose section 47 has one end 47*a* thereof connected to coupling 55 and the opposite end thereof connected to fitting 34*a*, whereupon as the valve Z is opened the interior of tank 21 is charged to the proper pressure; (c) if substantial heating of the product is required, the flexible hose sections 56 and 58 are connected to inlet and outlet connections 57 and 60, respectively, of the tank car 20 and to the appropriate valved fittings at the adjacent station V; (d) fitting 42 is attached to the discharge port 23 of the tank car 20 and duct section 45 connected to the discharge end of the fitting 42; (e) if the interior of the truck tank 30 is to be flushed out with hot water, such a step is performed before the flexible portion 45*b* of the duct section 45 is connected to the truck tank inlet port 48; (f) whether the interior of the truck tank 30 needs to be cleaned be determined by inspection through opening the cover or lid on the dome 30*a* provided on the upper side of the tank 30; and (g) once the tank interior is in a proper state of cleanliness to receive the product, the dome lid will remain partially opened while the inlet valve 54 on the truck and the discharge valve 24 on the tank car 20 are adjusted to open positions whereupon by reason of the interior pressure within tank 21 the product will flow from the railroad car to the parked tank truck. Contamination of the product being transferred is avoided by reason of the compressed air being filtered and in a dry state.

Once the desired amount of product has been transferred to the tank truck, the valve 24 at the discharge port 23 of the tank car 20 is closed. Hose 47 has been previously connected between fitting 34*a* and fitting 46 on elbow 42. Once valve 24 has been closed, valve X will be manually adjusted so that the compressed air will effectively purge the duct section 45 of any product before the flexible portion 45*b* of the duct section 45 is disconnected from the inlet port 48, subsequent to the valve 54 being closed, and thus eliminate or substantially eliminate product spillage. If the tank car 20 is empty then the rigid portion 45*a* of the duct section 45 is also disconnected from fitting 44 and the latter in turn removed from the discharge port 23 of the tank car. To facilitate handling of the rigid portion 45*a* the latter is preferably formed of a lightweight metallic or plastic material.

In certain instances it may be desirable to blend various flowable products from two adjacent tank cars prior to the admixture entering the tank truck 30. In such a case, a Y fitting, not shown, may be inserted in duct section 45 between portions 45*a* and *b* with one arm of the Y fitting being connected to the portion 45*a* and the other arm connected to the duct section of the adjacent car.

An alternative way of pre-heating and agitating a tank car 20 from that heretofore described may be to install the fitting 42 on the car 20 and then cap the discharge end of the fitting. The air hose 47 is then connected to coupling 46 and valves 24 and X are adjusted to an open position. Before open valve 24, however, a check should be made to be assured that the dome cover 22*a* is securely in place and valve Z is open. Once valves 24 and X are opened, the heated compressed air will percolate up through the product contained in tank 21. In addition to heating the product, the percolating compressed air will cause a certain amount of agitation of the product within the tank.

In comparing the time involved in loading under similar climatic conditions a conventional tank truck having a 45,000 lbs. capacity, the improved method herein described, when utilizing a compressed air pressure of 60 psig, can load the tank truck where the product is fructose approximately ten times faster than the conventional prior method utilizing a 3-inch Viking type 15 horsepower pump; and where the product is corn syrup approximately five times faster. Thus, it is apparent from these comparative figures that the idle time for the tank truck during loading is substantially reduced, thereby amounting to substantial saving in transportation costs to the customer.

While the description of the apparatus and method has heretofore been in relation to a product such as corn syrup and fructose, the invention is not intended to be limited thereto. Other fluid or granular products might be transferred from one container to another in a manner as herein set forth. Furthermore, the types of containers involved may be varied from those herein disclosed and illustrated without departing from the scope of the invention.

Thus, it will be appreciated that a simple, efficient, inexpensive and expeditious method and apparatus have been provided for transferring a flowable product from one container to another without requiring pumps and other costly and complex equipment, and without an inordinate amount of manual labor being expended. Furthermore, the improved method and apparatus may effectively operate under extreme climatic conditions and be utilized with containers varying widely in size and shape.

I claim:

1. A method of transferring within a predetermined time interval by a compressed fluid a selected amount of flowable product from one bulk container to a second bulk container, said one container being provided with a valved product discharge port, a fitting connected to the port and having a compressed fluid first inlet disposed adjacent to but downstream of the valved discharge port, and a compressed fluid second inlet communicating with the interior of said one container, and said second container being provided with a valved product inlet port and adjustable means for relieving pressure buildup within the second container while the product is flowing therein; said method comprising charging the interior of the one container to a predetermined pressure by connecting the second inlet to a source of the compressed fluid; removably connecting a duct section to the fitting and the product inlet port subsequent to the valves of said ports being adjusted to closed positions; adjusting the port valves to fully open positions after the duct section is in place; adjusting the pressure relief means of the second container to a pressure relief position; adjusting the valved product discharge port to a closed position after the predetermined time interval has elapsed; connecting the fitting first inlet to the source of compressed fluid and purging the duct section of flowable product; adjusting the valved product inlet port of the second container to a closed position subsequent to the duct section being purged of the flowable product; and disconnecting the duct section from at least the port of one of the containers.

2. The method of claim 1 wherein the flow rate of the compressed fluid entering the duct section through the fitting first inlet during purging of the duct section is controlled.

3. The method of claim 1 wherein the product is preheated within the one container to a predetermined temperature prior to being discharged therefrom.

4. A method of transferring within a predetermined time interval by a compressed fluid a selected amount of flowable product, when at a temperature for optimum fluidity, from one bulk container to second bulk container, the one container being provided with a compressed fluid first inlet communicating with the interior of the one container, a valved product discharge port, a fitting removably mounted on and extending from said port and having an outlet downstream of the discharge port, and a compressed fluid second inlet disposed between the discharge port and the outlet, the one container being capable of withstanding a predetermined maximum interior pressure, and the second container being provided with a valved product inlet port, and adjustable means for relieving pressure buildup within the interior of said second container; said method comprising charging the interior of the one container with the compressed fluid to a given pressure below the predetermined maximum interior pressure of said one container and maintaining substantially the said given pressure within the one container interior while the selected amount of product is being transferred from the one container to the second container; maintaining the product within the one container at a temperature for optimum fluidity; removably connecting a duct section to the fitting outlet and the product inlet port of the second container subsequent to the valves of the product outlet and inlet ports being adjusted to closed positions adjusting the valves of the discharge and inlet ports to fully open positions subsequent to the duct section being in place; adjusting the pressure relief means of the second container to a pressure relief position; adjusting the discharge port valve to a closed position after the predetermined time interval has elapsed; connecting the source of compressed fluid to the fitting compressed fluid second inlet; adjusting the flow rate of the compressed fluid through the second inlet and purging the duct section of flowable product; adjusting the product inlet port valve of the second container to a closed position; and disconnecting the duct section from at least the product inlet port of the second container.

5. The method of claim 4 wherein at least the second container is mobile and of lesser volumetric capacity than the said one container, and when the selected amount of product is being transferred said mobile container in parked adjacent the said one container; upon completion of the selected amount of product transfer and subsequent to the duct section being disconnected from the mobile container, the latter is moved away from the one container.

6. The method of claim 5 wherein both bulk containers are mobile but are parked adjacent one another while the product is being transferred from the one container to the second container.

7. The method of claim 4 wherein the compressed fluid is a heated gas.

8. A system for transferring a selected amount of a flowable product within a predetermined interval of time from one bulk container capable of withstanding a predetermined maximum interior pressure to a mobile second bulk container of smaller capacity parked within a given area in close proximity to the one container; the one container being provided with a valved product discharge port, and a compressed fluid inlet communicating with the container interior; the mobile second container being provided with a valved product inlet port and means for relieving pressure buildup within the interior of the second container during flow of the product into the second container; said system comprising a source of compressed fluid disposed at a first station in proximity to the one container; flexible hose means having one end thereof connected to said compressed fluid source and the other end for selective connection to the compressed fluid inlet of said one container to effect charging the interior thereof with compressed fluid to a given pressure below the predetermined maximum interior pressure of the one container; a fitting removably mountable on the one container valved discharge port and provided with a product outlet and a second compressed fluid inlet disposed upstream of said outlet and adapted to be selectively connected to the other end of said flexible hose means; and an elongated removably mounted duct section for interconnecting the product inlet port of the second container and the fitting product outlet; the selected amount of product being transferred when the interior of the one container is charged to the given pressure, the duct section is in place, and the valved ports of the containers are fully opened; after the predetermined time interval has elapsed the one container valved discharge port is closed and the hose means is connected to the second compressed fluid inlet whereupon the duct section is purged of product, the valved inlet port of the second container is closed and the end of the duct section disconnected therefrom and the second container removable from the given area.

9. The system of claim 8 wherein the one bulk container includes a railroad tank car parked at a railroad siding and the first station is adjacent thereto.

10. The system of claim 9 wherein a plurality of flexible hose means extend from the source of compressed fluid at said first station and are adapted to be simultaneously connected to the compressed fluid inlets provided on a plurality of railroad tank cars parked in proximity to said first station.

11. The system of claim 10 wherein the compressed fluid is a heated gas.

12. The system of claim 11 wherein the first station includes a source of compressed heated dry air, a source of steam, a steam condensate return line, a source of hot water, and valve means for independently regulating the flow of the air, steam and water from said first station.

13. The system of claim 8 wherein the first station is provided with a heating source and means extending therefrom for removably connecting to the one container and effecting heating of the product contained therein to a temperature wherein the product has optimum fluidity.

* * * * *

UNITED STATES PATENT OFFICE

CERTIFICATE OF CORRECTION

Patent No. 4,150,700 Dated April 24, 1979

Inventor(s) Kenneth L. Fox, Jr.

It is certified that error appears in the above-identified patent and that said Letters Patent are hereby corrected as shown below:

Column 3, line 62, "ajacent" should read --adjacent--.

Column 6, line 63, after "cleaned" should read --can--.
Column 9, line 27, "in" should read --is--.

Signed and Sealed this

*Twenty-fifth* Day of *September 1979*

[SEAL]

*Attest:*

*Attesting Officer*

LUTRELLE F. PARKER
*Acting Commissioner of Patents and Trademarks*